US009149815B2

(12) United States Patent
Köhn et al.

(10) Patent No.: US 9,149,815 B2
(45) Date of Patent: Oct. 6, 2015

(54) LID FOR CLOSING A CENTRIFUGE ROTOR

(75) Inventors: Heinz Gerhard Köhn, Hamburg (DE); Eckhard Kopowski, Braunschweig (DE); Andreas Heilmann, Borsdorf (DE)

(73) Assignee: Eppendorf AG, Hamburg (DE)

( * ) Notice: Subject to any disclaimer, the term of this patent is extended or adjusted under 35 U.S.C. 154(b) by 1904 days.

(21) Appl. No.: 12/301,842

(22) PCT Filed: May 23, 2006

(86) PCT No.: PCT/EP2006/004911

§ 371 (c)(1),
(2), (4) Date: May 20, 2011

(87) PCT Pub. No.: WO2007/134624

PCT Pub. Date: Nov. 29, 2007

(65) Prior Publication Data

US 2011/0212819 A1 Sep. 1, 2011

(51) Int. Cl.
*B04B 7/02* (2006.01)
*B04B 5/04* (2006.01)

(52) U.S. Cl.
CPC ..... *B04B 7/02* (2013.01); *B04B 5/0414* (2013.01); *B04B 2007/025* (2013.01)

(58) Field of Classification Search
CPC ..... B04B 7/02
USPC ..... 494/10, 12, 38
See application file for complete search history.

(56) References Cited

U.S. PATENT DOCUMENTS

| | | | | |
|---|---|---|---|---|
| 4,360,151 | A | 11/1982 | Cowell et al. | |
| 5,344,380 | A * | 9/1994 | Chern et al. | 494/12 |
| 6,063,018 | A | 5/2000 | Letourneur | |
| 6,149,570 | A * | 11/2000 | Lowe et al. | 494/12 |
| 8,105,556 | B2 | 1/2012 | Romanauskas et al. | |
| 2003/0144124 | A1 * | 7/2003 | Schutz | 494/12 |
| 2004/0018928 | A1 | 1/2004 | Schutz et al. | |
| 2004/0224831 | A1 | 11/2004 | Potter | |

FOREIGN PATENT DOCUMENTS

| | | |
|---|---|---|
| JP | H04-81131 | 3/1992 |
| JP | H06-342755 | 12/1994 |
| JP | 2005-074109 | 3/2005 |
| WO | WO 83/04379 | 12/1983 |

OTHER PUBLICATIONS

International Preliminary Examination Report for PCT/EP2006/004911, issued Jan. 29, 2009.

* cited by examiner

*Primary Examiner* — Charles Cooley
*Assistant Examiner* — Marc C Howell
(74) *Attorney, Agent, or Firm* — White & Case LLP

(57) ABSTRACT

The present invention relates to a lid for closing a centrifuge rotor, characterized by a form-fitting, rotation-actuated closure mechanism which, pre-positioned on the centrifuge rotor, moves automatically into a closed position by virtue of the intrinsic weight of the lid.

10 Claims, 2 Drawing Sheets

LID FOR CLOSING A CENTRIFUGE ROTOR

FIELD OF THE INVENTION

The present invention relates to a lid for closing a centrifuge rotor.

BACKGROUND OF THE INVENTION

Centrifuges are devices with which containers can be subjected to centrifugal force. In the laboratory, for example, suspensions in test tubes can be treated in this way in order to precipitate the floating solid material at the bottom of the test tube. As a rule, centrifuges have a rotary drive with a vertical drive shaft, on which a rotor can be placed. Normally provided in the rotor are compartments, into which containers which are to be centrifuged can be inserted. The rotors of the centrifuge are often interchangeable, in order to centrifuge vessel contents in one of the rotors while other rotors are only just being loaded with containers, or can be ready for further processing together with containers already centrifuged.

Since, for example, test tubes are pushed into the rotors so as to be open at the top, operational reliability is served, inter alia, by keeping the containers in a liquid-tight chamber during the centrifuging in the rotor. On the other hand, this chamber should be accessible as well as possible for the purpose of simple loading. Since, in particular in the laboratory, a number of actions are often carried out at the same time and the centrifuges nevertheless have to be closed carefully, it is particularly advantageous to be able to use devices having as few actions as possible, having as little actuating movement as possible and, if at all possible, operationally reliably with only one hand. In this regard, known centrifuges need improvement.

SUMMARY OF THE INVENTION

The present invention is based on the object of devising a lid for closing a centrifuge rotor in which the handling is simplified.

According to the invention, this object is achieved by a lid having the features of claim 1 or 11. Preferred refinements of the invention are specified in the subclaims.

According to the invention, a lid for closing a centrifuge rotor is characterized by a form-fitting rotation-actuated closure mechanism which, pre-positioned on the centrifuge rotor, moves automatically into a closed position by virtue of the intrinsic weight of the lid. As a preferred refinement of the same or alternatively, a closure mechanism of the lid according to the invention indicates the closed end position of the lid on the centrifuge rotor acoustically, in particular by means of a snapping or clicking noise.

For instance, a lid according to the invention can be rotationally symmetrical about a substantially vertical axis—preferably the axis of rotation of the rotor—and (similarly to a cooking pot lid having a central knob) can have a central grip knob, with which the lid can be placed on the rotor from above. Then, if the closure mechanism is for example a movement thread having a sufficiently large slope angle then, after being pre-positioned at the start of the thread, the lid can rotate automatically into a closed position by virtue of the intrinsic weight of the lid, guided in the thread. The closure mechanism preferably comprises a locking means at the completely closed position of the lid—for example at the end of the thread. In this way, therefore, given this configuration according to the invention, it is sufficient to pre-position the lid on the rotor from above with one hand on the grip knob, then to release it, so that it itself rotates downward into a virtually closed position and, finally, to turn it further by a few degrees on the same grip knob, so that the lid locks in a closed position in a then liquid-tight manner.

The locking means can be form-fitting, for example by the lid being seated on its seals, which effect the tightness, before being locked and, for example, counter to its resilient deformability, then coming to lie with a form fit over a locking ledge with a pin in a locking undercut.

The locking mechanism provided can—to a certain extent in a way similar in function to a thread—also be a bayonet, for example of the type as is known and widespread for interchangeable objectives on reflex cameras. In addition, the spring-prestressed locking means known from there, also having an actuating lever for releasing the locking means, can in principle be taken over directly for the lid according to the invention.

These and other features of the invention and their possible refinements will be described below with reference to the appended drawings.

DETAILED DESCRIPTION OF THE INVENTION

Figure 1:
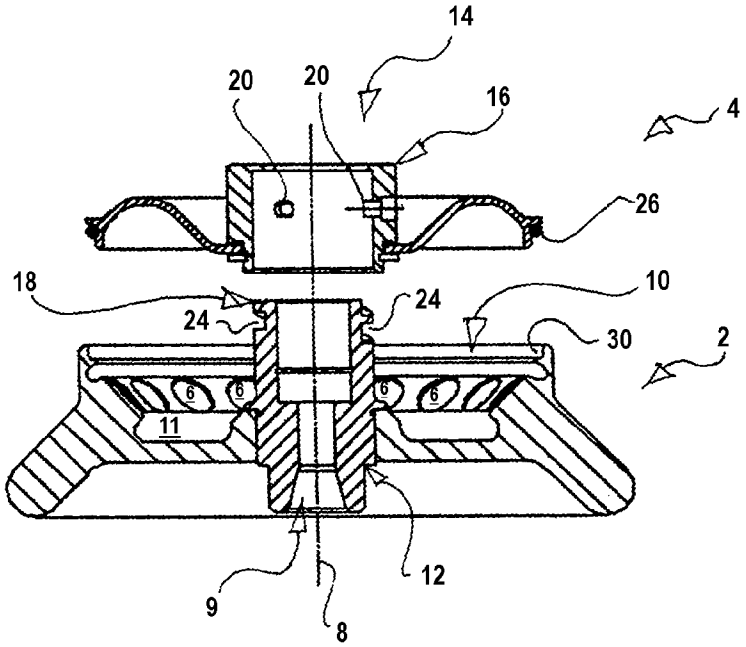
FIG. 1 shows a sectioned side view of a centrifuge rotor and a lid therefor.

FIG. 1 reveals a centrifuge rotor 2, above which a lid 4 is depicted, as is placed on the centrifuge rotor 2 by a hand (not illustrated) of a user. The centrifuge rotor 2 has a row of holes or compartments 6 distributed uniformly on the rotor periphery, into which test tubes (not illustrated) can be plugged, oriented obliquely outward at the bottom. Overall, the rotor is rotationally symmetrical about a vertical axis 8 and, at the center, has a vertical central hole 9, by means of which the rotor 2 can be plugged on to a centrifuge drive shaft (not illustrated) for the centrifuging.

The compartments 6 for test tubes are accessible through a large circular opening 10 in the top of the rotor 2. They are located on the radial outer wall of a bowl-like chamber 11, which extends annularly around a central hub 12.

Arranged in the bottom side of the hub 12 is the hole 9 for a centrifuge rotor drive shaft. Toward the top, the hub 12 projects to a certain extent circularly cylindrically out of the opening 10 and there forms a substantial element of a closure mechanism 14 of the lid 4. To be specific, the lid 4, which is circularly cylindrical in plan view, has in the top side of its centre a grip knob 16 projecting circularly cylindrically upward, which is hollow on the underside, therefore so to speak has the form of a cup or hat. Gripped from above, for example, the knob 16 with the lid 4 as a whole can be placed on the upper end 18 of the hub 12 and thus pre-positioned. Without further rotational movement, first of all the lid 4 falls vertically downward with the cup-like knob 16 along the vertical axis 8 on account of its intrinsic weight over the upper end 18 of the hub 12, until three thread pins 20 which project radially inward in the cup-like knob and which are distributed uniformly on the periphery of the internal space 22 of the cup-like knob 16 come to lie on the upper edge of the upper end 18 of the hub 12.

Figure 2:
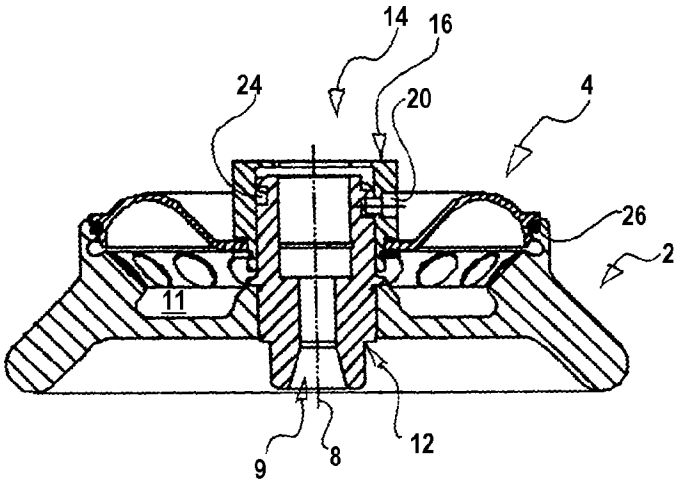
FIG. 2 shows a sectioned side view of the centrifuge rotor according to FIG. 1 with the lid in the (virtually) closed position.
Figure 3:
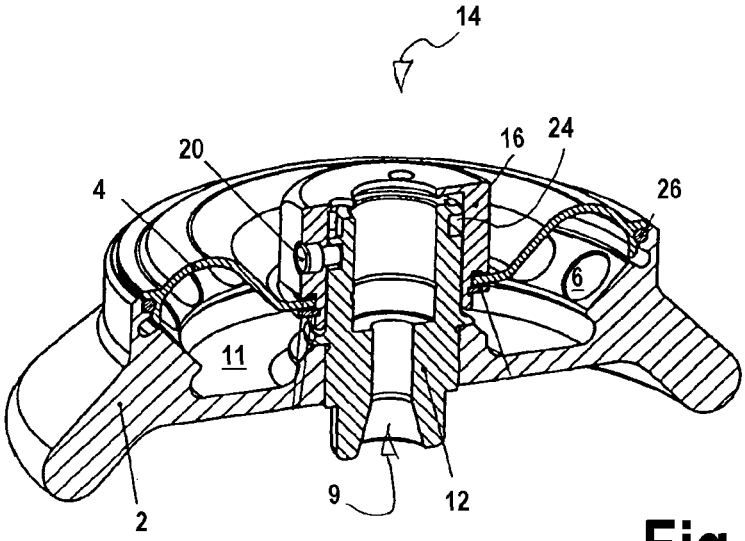
FIG. 3 shows a three-dimensional sectioned view of the centrifuge rotor with lid according to FIG. 1.
Figure 4:
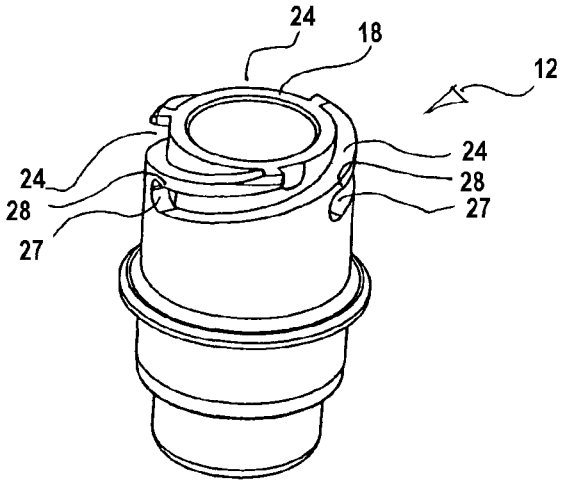
FIG. 4 shows a three-dimensional view of the closure mechanism of the centrifuge rotor according to FIG. 1.

Pre-positioned in this way, because of its intrinsic weight, the lid 4 slips further downward along the vertical axis 8 and, in the process, is set rotating in the clockwise direction by a three-start thread 24. The three-start thread 24 in the hub 12 can be seen particularly well in the three-dimensional view of FIG. 4. Looking at FIG. 4, the three-start thread 24 extends spirally downward on the periphery of the hub 12 in the form of three spiral grooves 24. The grooves 24 have such a width that the thread pins 20 can run in them, guided in the interior of the cup-like knob 16 but without jamming. Thus the lid 4 moves downward automatically by virtue of its intrinsic weight, rotating about the vertical axis 8, until its O-ring seal 26 (on the underside on the outermost rim of the lid) comes to lie on the upper edge of the rotor opening 10. This position of the lid 4 on the rotor 2 can be seen in FIG. 2.

Only in this position is it necessary for the user to grip the knob 16 once more (on the top of the lid) for the final liquid-tight closure of the lid 4 on the rotor 2 and to rotate it by a few degrees in order to lock the lid 4 on the rotor 2. Then, again looking at FIG. 4, it can be seen that, as the closure mechanism, the grooves 24 of the three-start thread have at their lower end a locking position 27 for the thread pin 20 behind a ledge 28. By means of active further rotation of the lid 4, guided by its thread pins 20 in the thread turns 24, the thread pins 20 then overcome the ledges or "humps" 20 counter to the prestress of the resilient seal 26, which is pressed in a liquid-tight manner into a sealing groove 30 on the outer rim of the rotor opening 10. Behind the humps 28, the thread pins 20 are then located and locked with a form fit in the locking positions 27 at the end of the thread turns 24.

The invention claimed is:

1. A rotor and lid for a centrifuge, wherein the lid and rotor comprise a form-fitting, rotation-actuated closure mechanism which is structurally configured to automatically rotate and guide the lid into a closed position without manual intervention by virtue of the intrinsic weight of the lid when the lid is pre-positioned on the centrifuge rotor, wherein:

the rotor has a plurality of sample compartments distributed along the interior of the rotor around a central hub, and the hub has (a) a lower end for engagement with a centrifuge drive shaft, and (b) an upper end having at least one spiral groove extending spirally down its outer periphery; and the lid has an upwardly projecting grip knob which is hollow and has a cup shape on its underside, and the grip knob has at least one thread pin distributed and projecting radially inward in the cup shape, the groove having a width such that the thread pin runs therein; and when the lid is pre-positioned on the rotor, the thread pin of the grip knob engages with and is guided by the corresponding spiral groove of the hub to cause the lid to automatically rotate down and into the closed position.

2. The rotor and lid according to claim 1, wherein the closure mechanism is rotationally actuated about a substantially vertical axis.

3. The lid and rotor according to claim 1, wherein the spiral groove is in the form of a multi-turn thread.

4. The rotor and lid according to claim 1, wherein the closure mechanism comprises a locking means in the form of a ledge or hump located on a lower portion of at least one spiral groove for placing the lid into a completely closed position, wherein the thread pin is rotated past the ledge or hump in order to completely close the lid.

5. The rotor and lid according to claim 4, wherein the locking means is form-fitting.

6. The rotor and lid according to claim 1, wherein the closure mechanism is a bayonet.

7. The rotor and lid according to claim 1, wherein the closure mechanism is arranged centrally on the lid.

8. The rotor and lid according to claim 1, wherein the closure mechanism is capable of being actuated single-handedly.

9. The rotor and lid according to claim 1, wherein the closure mechanism is designed to provide an acoustic indication that the lid is in the closed position.

10. The rotor and lid according to claim 1, wherein the upper end of the hub has a plurality of spiral grooves uniformly distributed and extending spirally down its outer periphery; and the grip knob has a plurality of thread pins uniformly distributed and projecting radially inward in the cup shape, and when the lid is pre-positioned on the rotor, the thread pins of the grip knob engage with and are guided by corresponding spiral grooves of the hub to cause the lid to automatically rotate down and into the closed position.

* * * * *